US009513076B2

(12) United States Patent
Kolev et al.

(10) Patent No.: US 9,513,076 B2
(45) Date of Patent: Dec. 6, 2016

(54) FIREARM WITH RECIPROCATING BOLT ASSEMBLY

(71) Applicant: Savage Arms, Inc., Westfield, MA (US)

(72) Inventors: Ivan Kolev, Broad Brook, CT (US); John Linscott, Holyoke, MA (US)

(73) Assignee: Savage Arms, Inc., Westfield, MA (US)

( * ) Notice: Subject to any disclaimer, the term of this patent is extended or adjusted under 35 U.S.C. 154(b) by 0 days.

(21) Appl. No.: 14/599,408

(22) Filed: Jan. 16, 2015

(65) Prior Publication Data

US 2015/0330727 A1 Nov. 19, 2015

Related U.S. Application Data

(60) Provisional application No. 61/993,541, filed on May 15, 2014, provisional application No. 61/993,563, (Continued)

(51) Int. Cl.
*F41A 15/14* (2006.01)
*F41A 19/10* (2006.01)
(Continued)

(52) U.S. Cl.
CPC ..... *F41A 15/14* (2013.01); *F41A 3/12* (2013.01); *F41A 3/46* (2013.01); *F41A 3/66* (2013.01);
(Continued)

(58) Field of Classification Search
CPC ..... F41A 3/66; F41A 3/68; F41A 3/72; F41A 3/44; F41A 3/36; F41A 3/46; F41A 3/26; F41A 17/42; F41A 17/64; F41A 17/66; F41A 19/25; F41A 19/26; F41A 19/27; F41A 19/28; F41A 19/30; F41A 3/54; F41A 3/70; F41A 19/29
See application file for complete search history.

(56) References Cited

U.S. PATENT DOCUMENTS 1,410,270 A 3/1922 Pedersen
1,656,961 A * 1/1928 Soncini ..... F41A 17/66 89/149
(Continued)

FOREIGN PATENT DOCUMENTS

CH 626717 A5 11/1981
EP 0 017 506 10/1980
WO WO 94/09334 4/1994

OTHER PUBLICATIONS

Guns & Ammo Network, "Innovative, Remarkable, Reliable . . . Getting Inside Savage's Accutrigger". Sep. 23, 2010. Available online at: http://www.shootingtimes.com/long-guns/longgun_reviews_savage_0813/ (8 pgs.).

*Primary Examiner* — Bret Hayes
*Assistant Examiner* — Derrick Morgan
(74) *Attorney, Agent, or Firm* — Christensen Fonder P.A.

(57) ABSTRACT

A semiautomatic firearm with a reciprocating bolt assembly has delayed blowback and a firing pin block. The firearm is particularly suitable for firing necked rimfire cartridges with a high level of reliability. Features prevent out-of-battery firing, when the bolt assembly is not fully engaged to the firing chamber or barrel face, a movable member within a bolt body functions as a blocking member that blocks the firing pin and prevents the firing pin from striking a cartridge. In embodiments, the firing pin has two stop portions that the movable member can engage depending on the cycle status of the firearm. A reverse cam mechanism associated with the firing pin blocking provides a resistance to and delays blowback. The bolt may interface with the necked rimfire cartridge using a undercut engagement on the forward end of the bolt. The semiautomatic firearm also may incorporate one or both of a dual trigger arrangement as part of a trigger and firing mechanism.

14 Claims, 13 Drawing Sheets

Related U.S. Application Data filed on May 15, 2014, provisional application No. 61/993,569, filed on May 15, 2014.

(51) Int. Cl.

| | |
|---|---|
| ***F41A 19/12*** | (2006.01) |
| ***F41A 19/16*** | (2006.01) |
| ***F41A 3/12*** | (2006.01) |
| ***F41A 3/66*** | (2006.01) |
| ***F41A 19/27*** | (2006.01) |
| ***F41A 21/00*** | (2006.01) |
| ***F41A 3/46*** | (2006.01) |
| *F41A 17/46* | (2006.01) |
| *F41A 19/14* | (2006.01) |

(52) U.S. Cl.

CPC ..... *F41A 19/10* (2013.01); *F41A 19/12* (2013.01); *F41A 19/16* (2013.01); *F41A 19/27* (2013.01); *F41A 21/00* (2013.01); *F41A 17/46* (2013.01); *F41A 19/14* (2013.01)

(56) References Cited

U.S. PATENT DOCUMENTS 1,737,974 A 12/1929 Pedersen
2,453,830 A * 11/1948 Chadwick ..... F41A 3/40 89/1.1
2,465,749 A * 3/1949 Rataiczak ..... F41A 17/66 89/133
2,473,373 A 6/1949 Howell
2,527,895 A * 10/1950 Tassan ..... C01B 31/14 89/165
2,576,973 A * 12/1951 Simpson ..... F41A 3/34 42/25
2,585,195 A 2/1952 Walker
2,594,354 A * 4/1952 Schnepel ..... F41A 3/46 89/187.01
2,601,808 A 7/1952 Clarke
2,603,019 A 7/1952 Elkas
2,626,474 A * 1/1953 Lochhead ..... F41A 17/66 42/16
2,638,694 A 5/1953 Morris
2,873,546 A 2/1959 Allyn
2,912,779 A 11/1959 Catlin et al.
2,921,502 A * 1/1960 Amsler ..... F41A 19/43 89/149
2,975,680 A 3/1961 Wilson
3,235,993 A 2/1966 Magardo
3,292,492 A 12/1966 Sturtevant
3,631,622 A 1/1972 Walker et al.
3,738,223 A 6/1973 Post et al.
3,848,510 A * 11/1974 Wolpert ..... F41A 3/46 89/173
3,857,325 A 12/1974 Thomas
3,893,369 A 7/1975 Benelli
4,069,607 A 1/1978 Jurek
4,203,243 A 5/1980 Hickman
4,270,295 A * 6/1981 Grehl ..... F41A 17/64 42/70.08
4,344,246 A * 8/1982 Bauman ..... F41A 17/66 42/69.03
4,547,988 A 10/1985 Nilsson
5,157,209 A * 10/1992 Dunn ..... F41A 17/64 42/70.08
5,655,326 A 8/1997 Levavi et al.
5,666,754 A * 9/1997 de Oliveira Masina ..... F41A 17/72 42/69.03
5,900,576 A * 5/1999 Gabriel ..... F41A 3/46 89/187.01
5,974,942 A 11/1999 Dionne
6,256,918 B1 * 7/2001 Szabo ..... F41A 17/72 42/69.03
6,418,655 B1 * 7/2002 Kay ..... F41A 3/46 42/70.08
6,553,706 B1 4/2003 Gancarz et al.
6,782,791 B2 8/2004 Moore
7,204,051 B2 * 4/2007 Thomele ..... F41A 17/72 42/69.03
8,220,193 B1 7/2012 Lynch
8,250,799 B2 8/2012 Duperry et al.
8,528,458 B2 9/2013 Windauer
2005/0257682 A1 * 11/2005 Hajjar ..... F41A 3/46 89/188
2010/0024273 A1 2/2010 Duperry et al.
2010/0186581 A1 * 7/2010 Hajjar ..... F41A 3/46 89/188
2010/0313459 A1 * 12/2010 Gomez ..... F41A 17/72 42/70.08
2011/0079137 A1 4/2011 Audibert et al.
2013/0074390 A1 3/2013 Wössner et al.
2013/0199069 A1 8/2013 Kerbrat et al.
2015/0330731 A1 * 11/2015 Kolev ..... F41A 15/14 42/25

* cited by examiner

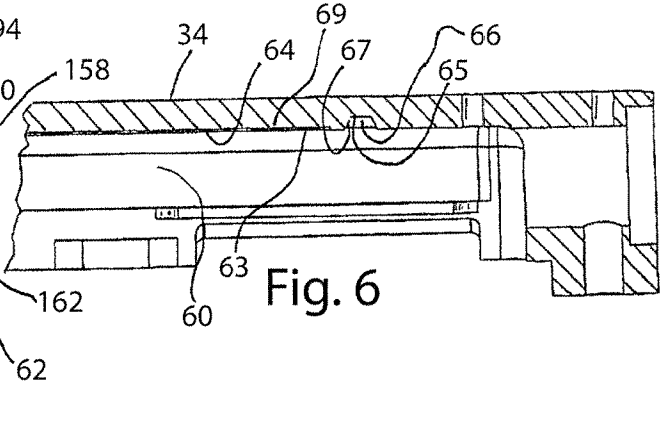
Fig. 6
Fig. 5
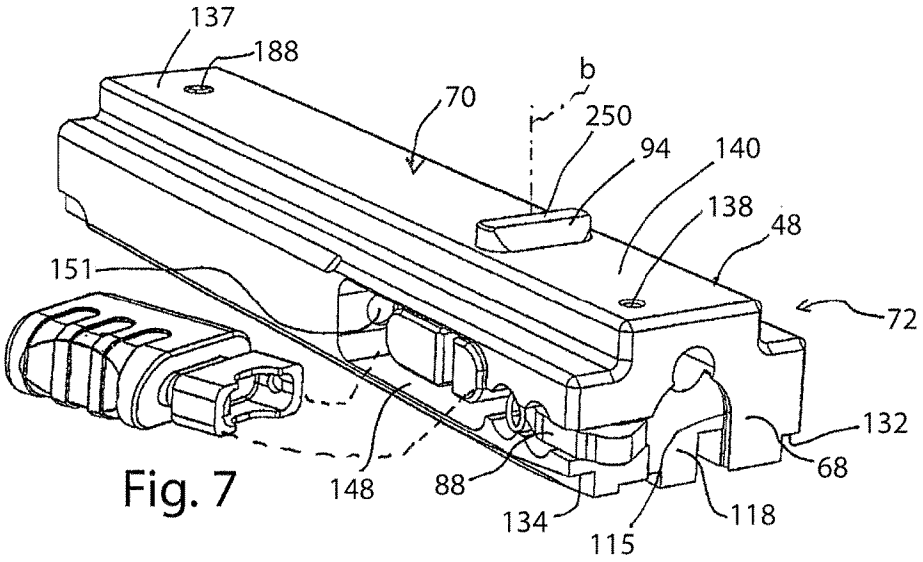
Fig. 7

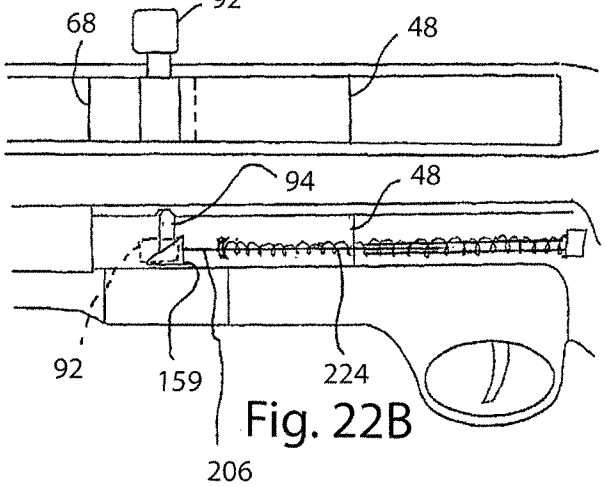
Fig. 22A
Fig. 22B
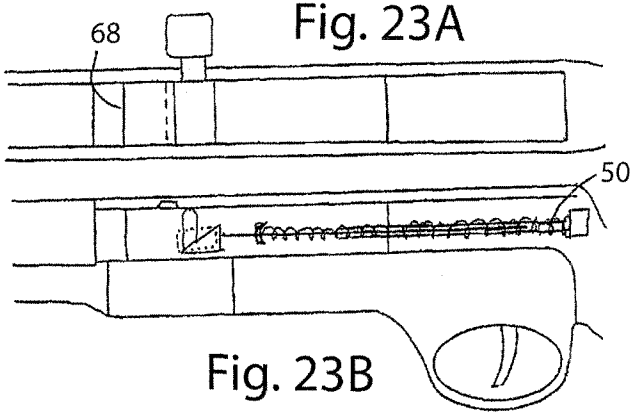
Fig. 23A
Fig. 23B
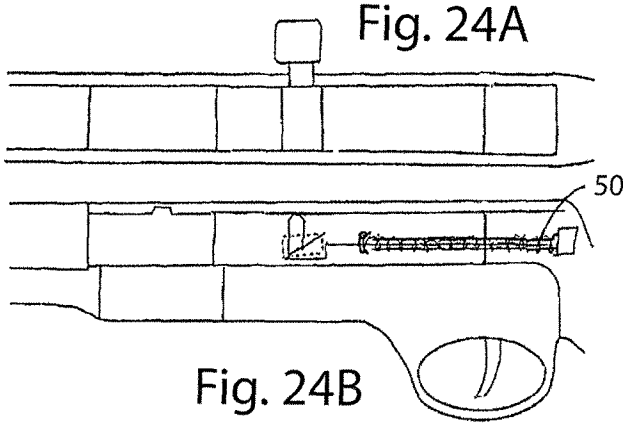
Fig. 24A
Fig. 24B
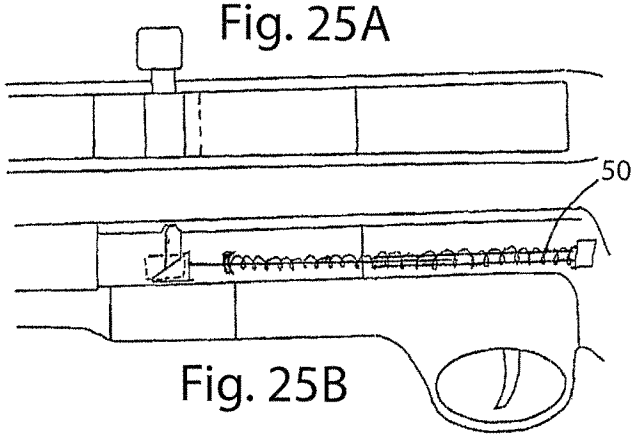
Fig. 25A
Fig. 25B

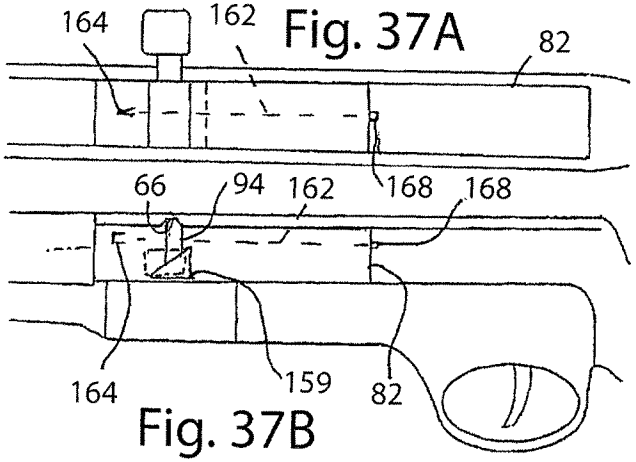
Fig. 37A
Fig. 37B
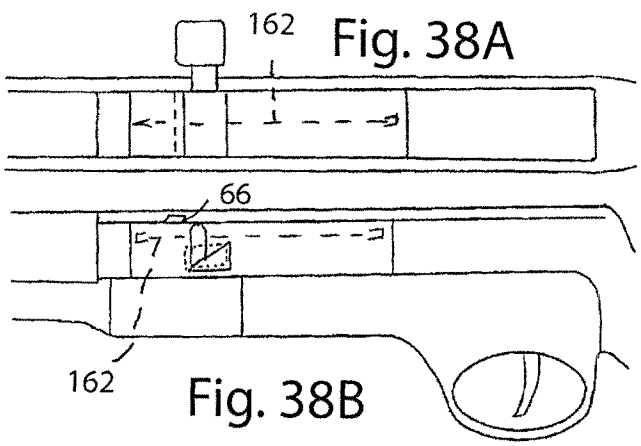
Fig. 38A
Fig. 38B
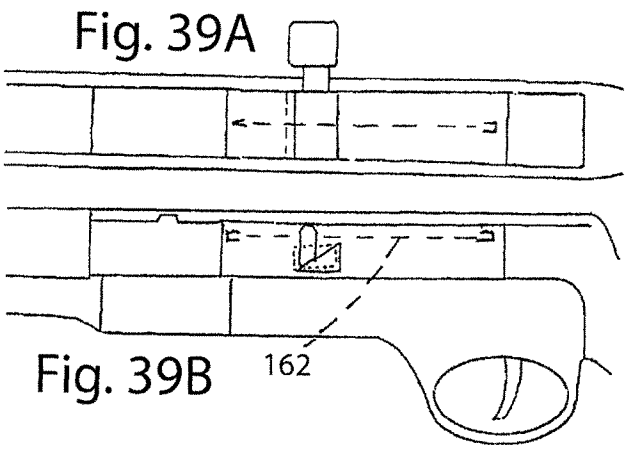
Fig. 39A
Fig. 39B
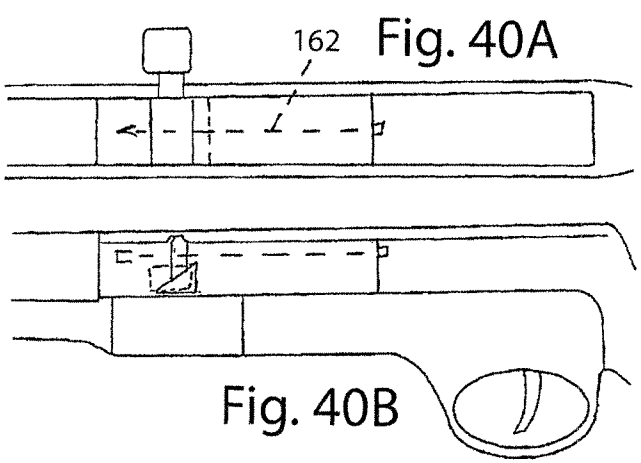
Fig. 40A
Fig. 40B 310
296
297
298
304
316
294
119
297
312
306

168
162
284
92
164
227
159
92

FIREARM WITH RECIPROCATING BOLT ASSEMBLY

RELATED APPLICATIONS

This application claims the benefit of U.S. Provisional Patent Application No. 61/993,541, filed May 15, 2014; U.S. Provisional Patent Application No. 61/993,563, filed May 15, 2014; and U.S. Provisional Patent Application No. 61/993,569, filed May 15, 2014, each of which are incorporated by reference herein. This application is related to co-pending U.S. application Ser. No. 14/599,396, entitled SEMIAUTOMATIC FIREARM, filed Jan. 16, 2015 and co-pending U.S. application Ser. No. 14/599,199, entitled EXTRACTOR MECHANISM FOR FIREARM, filed Jan. 16, 2015. The above-recited applications are hereby incorporated by reference herein in their entirety.

BACKGROUND OF THE INVENTION

The invention relates to cycling mechanisms for firearms, specifically for semiautomatic mechanisms. Such mechanisms require that the cartridge be retained in the firing chamber essentially until the bullet has left the barrel or the projectile velocity and performance will be impaired. These cartridges, for example the 0.17 Winchester Super Magnum (WSM) and the 0.17 Hornady Magnum Rimfire (HMR) are relatively inexpensive compared to high power centerfire cartridges and therefore have high consumer appeal for the recreation sport shooting market. Traditional rimfire semiautomatic recycling mechanisms generally rely on the weight of the bolt for providing a delay in "blowback" of the bolt. These mechanisms have not been proven suitable for high power necked rimfire cartridges due to the higher power and much greater rearward blowback force associated with these cartridges. Such mechanisms, for these cartridges, do not provide enough delay in the blowback of the bolt or the bolt weight is excessively heavy. The cycling mechanisms for the more powerful necked centerfire cartridges are not suitable either in that the rimfire cartridges generally do not provide sufficient gas pressures for such mechanisms, for example, gas operated cycling mechanisms used in AR-15 type rifles. Even if such mechanisms could be adapted to the necked rimfire cartridges, such mechanism are complicated, requiring many moving parts and thus would be relatively expensive; particularly compared to semiautomatic .22 caliber non-necked rifles. Previous attempts at reasonably priced consumer oriented semiautomatic rifles for these high power rimfire cartridges have had performance issues, such as jamming and out-of-battery firing of cartridges. A reliable, mechanically simple, semiautomatic firearm with improved performance, particularly for high power necked rimfire cartridges, would be welcome.

SUMMARY OF THE INVENTION

In particular embodiments, a system delays blowback in firearms with reciprocating bolt assemblies in semiautomatic firearms and is particularly suitable for high power necked rimfire cartridges. A feature and advantage of embodiments of the invention is that enhanced reliability and minimization of out-of-battery firing of cartridges is provided. In embodiments, a semiautomatic firearm utilizes cooperating and common components to provide both a delayed blowback and a lockout of the firing pin when a bolt assembly is out-of-battery.

In embodiments of the invention, a movable member within a bolt body functions as a blocking member that blocks the firing pin and preventing the firing pin from striking a cartridge when the bolt is not in battery. In embodiments, the firing pin has two stop portions that the movable member can engage depending on the cycle status of the firearm. One stop portion, when blocked, prevents the firing pin from traveling into cartridge headspace when the hammer receiving end of the firing pin is struck by the hammer, the other stop portion, when blocked, prevents the firing pin from retracting to the ready to fire position such that the hammer receiving end of the firing pin is not exposed and thus cannot be struck.

In embodiments, in an in-battery position, when the bolt assembly is closed on the firing chamber, a movable blocking member is in a non-blocking position with respect to the firing pin. The movable blocking member has a projecting portion extending from the bolt body to be removably received in a recess of the firearm housing, for example a ceiling of the receiver. The movable blocking member may be biased to urge the projecting portion outwardly into the recess. When the blocking member is in the non-blocking position the firing pin is free to travel past the blocking member and into headspace of the bolt body to achieve ignition. In embodiments, the blocking member may be engaged with a spring assembly for providing the bias. In embodiments, a separate blocking member carrier or cammed intermediary member, movably forwardly and rearwardly in the bolt body, may be engaged with a spring assembly to provide the outwardly bias to the blocking member through the intermediary member. The intermediary member may have a ramp portion that the blocking member rides up with the spring assembly urging the ramp portion against the blocking member thereby urging the blocking member to ride up the ramp.

In embodiments, the bias urging the blocking member outwardly may be manually removed by a manual handle, for example by manually retracting the ramp portion that is engaged with and urging the blocking member outwardly. The manual handle may be moved slightly rearwardly to back off the ramp and allow the movable member to retract to again put the blocking member in a blocking position with respect to the firing pin. Further motion of the manual handle then can pull the bolt assembly rearwardly to eject a cartridge engaged with the bold assembly.

In embodiments of the invention, a movable member performs a locking function with respect to the in-battery position of the bolt assembly such that upon firing there is a delay in the retraction of the bolt assembly while the movable member unlocks. The movable member may extend from the bolt body outwardly to engage a recess in the firearm housing and be retractable inwardly between, respectively, a locked and an unlocked position. The movable member can extend and retract along an axis normal or transverse to the axis of the reciprocating bolt assembly and the axis as defined by the barrel bore. The movable member may have a bias towards the extended-locked position. In an embodiment the bias is provided by a ramp portion that is biased forwardly by a recoil spring assembly pushing a wedge under the movable member providing the bias outwardly. When the movable member is received in the recess in the housing an outwardly facing cam surface of the movable member engages a transition cam surface (an inclined surface) of the firearm housing requiring the transition cam surface to push the movable member inwardly with respect to the bolt assembly in order to escape the recess. Such inward movement requires retracting of the ramp portion within the bolt body, and due to the change of direction of the force, from normal or transverse to the axis of the reciprocating bolt assembly to a direction parallel to said axis, requires substantially more force than the force to overcome a force provided by the recoil spring assembly, for example, under the movable member. The movable member attempting to push the ramp portion downwardly is, appropriately termed, a reverse cam mechanism. The downward force increases the frictional resistance between the ramp portion and the surface upon which it slides and only a component of the downward force is translated to move the ramp portion. This component acts against and must overcome the frictional resistance as well as any additional spring force provided to resist the movement.

A feature and advantage of embodiments of the invention is that a cam mechanism is utilized in a normal forward fashion in association with a manual handle in a reciprocating bolt assembly of a semiautomatic firearm and is used in a reverse manner to delay blowback.

A feature and advantage of embodiments of the invention is a movable member slidingly constrained within the bolt body that locks out the firing pin, the movable member can be moved with respect to the lockout of the firing pin by cam surfaces engaging opposing ends of the movable member. A feature and advantage is that the movable member may be block shaped with a firing pin opening therethrough that provides the firing pin block. A feature and advantage is that the block shaped movable member is not attached by pins or the like within the bolt and is simply slidingly constrained within open spaces in the bolt and breech region. Such a configuration eliminates wear issues, dirt and debris issue, and lubrication associated with using joints and pivot points for constraining moving parts. Moreover, in that the movable member has opposite ends which both are utilized as cam follower surfaces, this "float" of the movable member, with some free play in the constraint of the movable member, facilitates even engagement of the cam surfaces which the cam followers follow.

In embodiments, the movable member has a projecting locking tab that extends to engage a recess or stop surface in the ceiling of the receiver. The firing pin is blocked, or locked out, except when the tab is extending. The only recess or place for the locking tab to extend correlates to an in-battery position of the bolt assembly in an engaged ready-to-fire position.

A feature and advantage of embodiments of the invention is that mechanisms are utilized for delaying blowback that are contained mostly within the bolt body and therefore have minimal or reduced exposure to firing byproducts and contaminants.

A feature and advantage of embodiments of the invention is that the bias provided to the delayed blowback mechanism is a readily accessible spring that may be easily inspected and replaced if necessary.

In embodiments of the invention, the bolt assembly can be manually moved forwardly and rearwardly and pushed into an in-battery position if it is not in such a position. A manual handle extends from the bolt assembly and is directly engaged with the movable member carrier that traverses from the left side of the bolt body to the right side. The movable member carrier is moveable in a forward and rearward direction a limited amount within the bolt body, the limited movement associated with moving the movable blocking member up and down the ramp. The movable blocking member carrier may have the ramp surface, effectively a cam surface, engaged with the movable blocking member such that forward and/or rearward movement of the movable blocking member carrier moves the cam surface and a cam follower surface on the movable blocking member engaged with the cam surface causes the movable blocking member to move upwardly or downwardly.

A feature and advantage of embodiments of the invention is a semiautomatic firearm with a blocking member as part of a bolt assembly that moves in a vertical direction, up and down, between a blocking and non-blocking position with the firing pin. The blocking member needs to be in an upward or extended position, the non-blocking position, for the firing pin to be able to be struck by the hammer and translate forward to reach and impact a cartridge in a firing chamber.

A feature and advantage of embodiments of the invention is that particular components have multiple functions, thereby saving weight and minimizing the number of moving parts. For example, the movable member provides a delayed blowback mechanism for the bolt assembly and also provides a blocking or lockout for the firing pin when the bolt is not fully in the in-battery position. Moreover, the recoil spring assembly connected between the bolt assembly and the firearm frame may provide at least two functions. First the spring assembly provides forward bias to the bolt such that as the bolt is blown backwards the spring assembly cycles the bolt assembly forwardly, and second, the spring assembly provides an outward bias to the blocking member an intermediary member that engages the blocking member with a cam surface to urge the blocking member upwardly.

A feature and advantage of embodiments of the invention is that a delay in the bolt assembly blowback is affected by the disengagement of a projection extending from the bolt engaging the receiver that secures the receiver in an in-battery motion translation mechanism operating against spring aligned in the axis of the bolt assembly. A feature and advantage of embodiments is that the projection can be manually retracted from the receiver with a handle connecting to member that, by way of a ramp or cam surface extends and retracts the projection which allows opening of the bolt.

A feature and advantage of embodiments of the invention is that delay in the bolt assembly blowback is provided first by two serially connected motion translation mechanisms, in particular, two cam/cam follower mechanisms. In an embodiment, a spring bias is provided to the second cam follower mechanism. Moreover, the delayed blowback mechanism does not require a connection to the receiver by the mechanism, only a cam/cam follower engagement.

A feature and advantage of embodiments of the invention is the simplicity in that a single component both engages with a stop portion fixed with respect to the receiver for locking the bolt assembly in an in battery position and also engages with the firing pin to block the firing pin when the bolt assembly in an out of battery position. The movable member alternately locks the bolt and then blocks the firing pin providing simplicity of design and enhanced reliability, which is particularly effective in minimizing out-of-battery misfires.

In embodiments, a semiautomatic firearm with a reciprocating bolt in a receiver, the bolt may be manually retracted by pulling rearwardly a manual handle attached to a ramp portion that releases the engagement of the ramp with an outwardly projecting movable locking member with a stop portion fixed with respect to the receiver. The manual handle first releases the locking member with the rearward manual force on the handle, and then moves the bolt rearwardly with the continuing rearward manual force on the handle. Moreover, releasing the outwardly projecting movable locking member then blocks the firing pin decreasing out of battery misfires.

In embodiments of the invention, a bolt assembly of a semiautomatic firearm comprises a firing pin that has travel between a ready-to-fire position, a fire position, and two intermediate positions where it may be held or blocked. In embodiments the firing pin is held in the two intermediate positions by a blocking member that moves into and out of a blocking position. In embodiments the blocking member is the movable member that moves inwardly and outwardly with respect to the bolt body as the bolt assembly travels forwardly and rewardly.

In embodiments of the invention, a method of delaying the blowback of a bolt in an in-battery position after firing is provided by constraining a movable member within the bolt, the member movable in a direction transverse to the blowback direction of the bolt, positioning the movable member in a recess fixed with respect to a frame constraining the bolt, whereby the bolt cannot blowback until the movable member retracts, and providing a bias to resist the retraction, In embodiments the bias may be provided by a spring operating directly on the movable member. In embodiments, the method further may having the movable member engaging with a ramp portion such that the ramp portion must be moved, pushed out of the way, by the movable member pressing against a ramped surface of the ramp portion. In embodiments further comprising biasing the ramp portion to resist the movable member pushing it out of the way. The method comprising pushing the ramp portion out of the way to retract the movable member from the recess which then allows blowback of the bolt. Further, embodiments provide methods of locking out the firing pin depending on the positioning of the movable member.

Embodiments of the invention feature a sliding bolt assembly with a movable member with an outward projection, the outward projection having a sliding engagement surface. The movable member is part of the bolt assembly so it moves with the bolt assembly but also is movable in a direction transverse to the sliding direction of the bolt assembly (the bolt assembly moves forwardly and rearwardly). The movable member moves inward and outward by slidingly engaging a surface with structure on the receiver or firearm frame as the bolt reciprocates. In embodiments of the invention, the movable member provides an in-battery lock and provides a firing pin block when the bolt is not in the in-battery position. In embodiments of the invention, the outward projection is an end of two opposing ends, the opposite end of the outward projection, an inward sliding engagement surface that engages a wedge portion. The wedge portion is movable in the forward/rearward direction with respect to the bolt assembly and the wedge is biased forwardly to push the movable member outwardly. In embodiments the movable member floats within and is captured by a bolt body of the bolt assembly. In other embodiments the movable member is pivotal with respect to the bolt body.

A feature and advantage of the inventive aspects herein, such as the particular mechanisms and components accomplishing the delayed blowback and lockout of the firing pin, may be suitable for firearms that fire cartridges other than the necked rimfire cartridges such as .22 caliber rimfire (non-necked) and necked or non-necked centerfire cartridges.

DESCRIPTION OF THE DRAWINGS

FIG. 5 is a cross sectional view of the firearm of FIG. 3A taken through the manual handle with the outwardly projectable movable member in a recess in the ceiling of the receiver in a non-blocking position with respect to the firing pin.

FIG. 6 is a cross-sectional view of the receiver of FIGS. 4 and 5 illustrating a recess including a cam surface in the ceiling of the receiver for receiving/engaging the movable member.

FIG. 7 is a perspective view of a bolt assembly with the manual handle separated therefrom.

FIG. 22A is top schematic plan view of a semiautomatic firearm with the bolt assembly in an in battery position.

FIG. 22B is a side schematic elevation view of the semiautomatic firearm of the FIG. 22A illustrating the position of the movable member.

FIG. 23A is top schematic plan view of the semiautomatic firearm of FIGS. 22A and 22B showing the position of the bolt assembly out of battery, for example after firing a cartridge.

FIG. 23B is a side schematic elevation view of the semiautomatic firearm of the FIG. 23A illustrating the position of the movable member.

FIG. 24A is top schematic plan view of the semiautomatic firearm of FIG. 23A with the bolt assembly in a full retracted position.

FIG. 24B is side schematic elevation view of the semiautomatic firearm of the FIG. 24A illustrating the position of the movable member.

FIG. 25A is top schematic plan view of a semiautomatic firearm of FIGS. 22A to 24B after the bolt assembly has recoiled to the in-battery position and the locking member is received in the recess in the receiver.

FIG. 25B is side schematic elevation view of the semiautomatic firearm of the FIG. 25A illustrating the position of the movable member.

FIG. 37A is schematic plan view showing the position of the firing pin with respect to the bolt assembly in the in-battery position.

FIG. 37B is schematic elevation view showing the position of the firing pin and movable member with respect to the bolt position of FIG. 37A.

FIG. 38A is schematic plan view showing the position of the firing pin with respect to the bolt assembly after ignition of a cartridge and out of the in-battery position.

FIG. 38B is schematic elevation view showing the position of the firing pin and movable member with respect to the bolt position of FIG. 38A.

FIG. 39A is schematic plan view showing the position of the firing pin with respect to the bolt assembly in the full recoil position of the bolt assembly.

FIG. 39B is schematic elevation view showing the position of the firing pin and movable member with respect to the bolt position of FIG. 39A.

FIG. 40A is schematic plan view showing the position of the firing pin with respect to the bolt assembly having returned to the in-battery position from the full recoil position with the firing pin rearward end exposed.

FIG. 40B is schematic elevation view showing the position of the firing pin and movable member with respect to the bolt position of FIG. 40A.

DETAILED DESCRIPTION

Figure 1A:
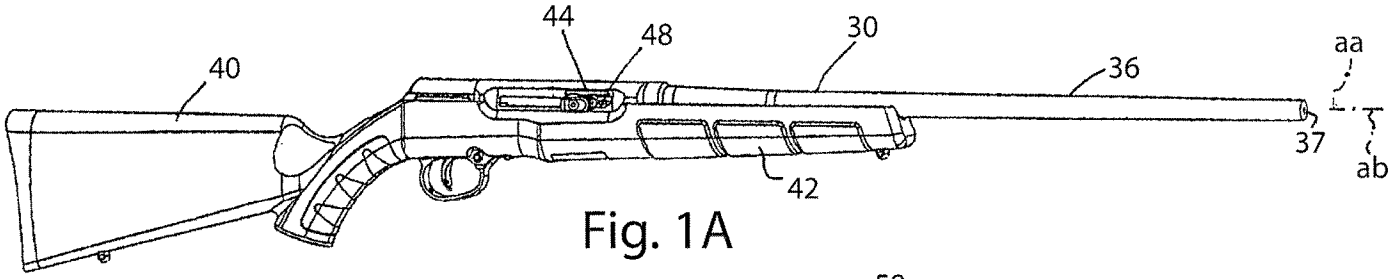
FIG. 1A is a perspective view of a semiautomatic firearm in accord with the inventions herein.
Figure 1B:
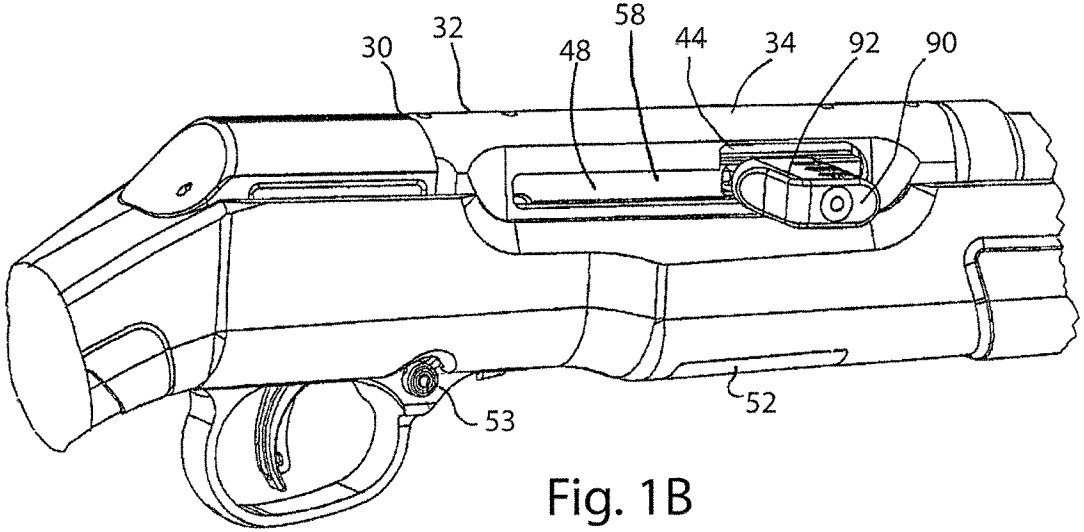
FIG. 1B is a more detailed perspective view of the semiautomatic firearm of FIG. 1.
Figure 2:
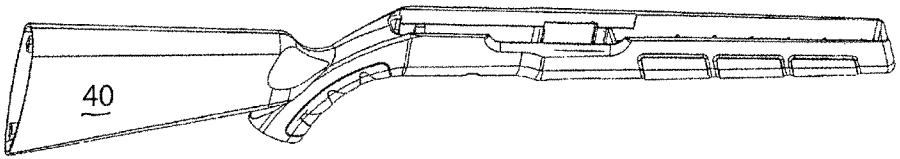
FIG. 2 is a perspective view of a molded stock for receiving the receiver, barrel, and trigger and firing mechanism of the firearm of FIG. 1.
Figures 3A, 3B:
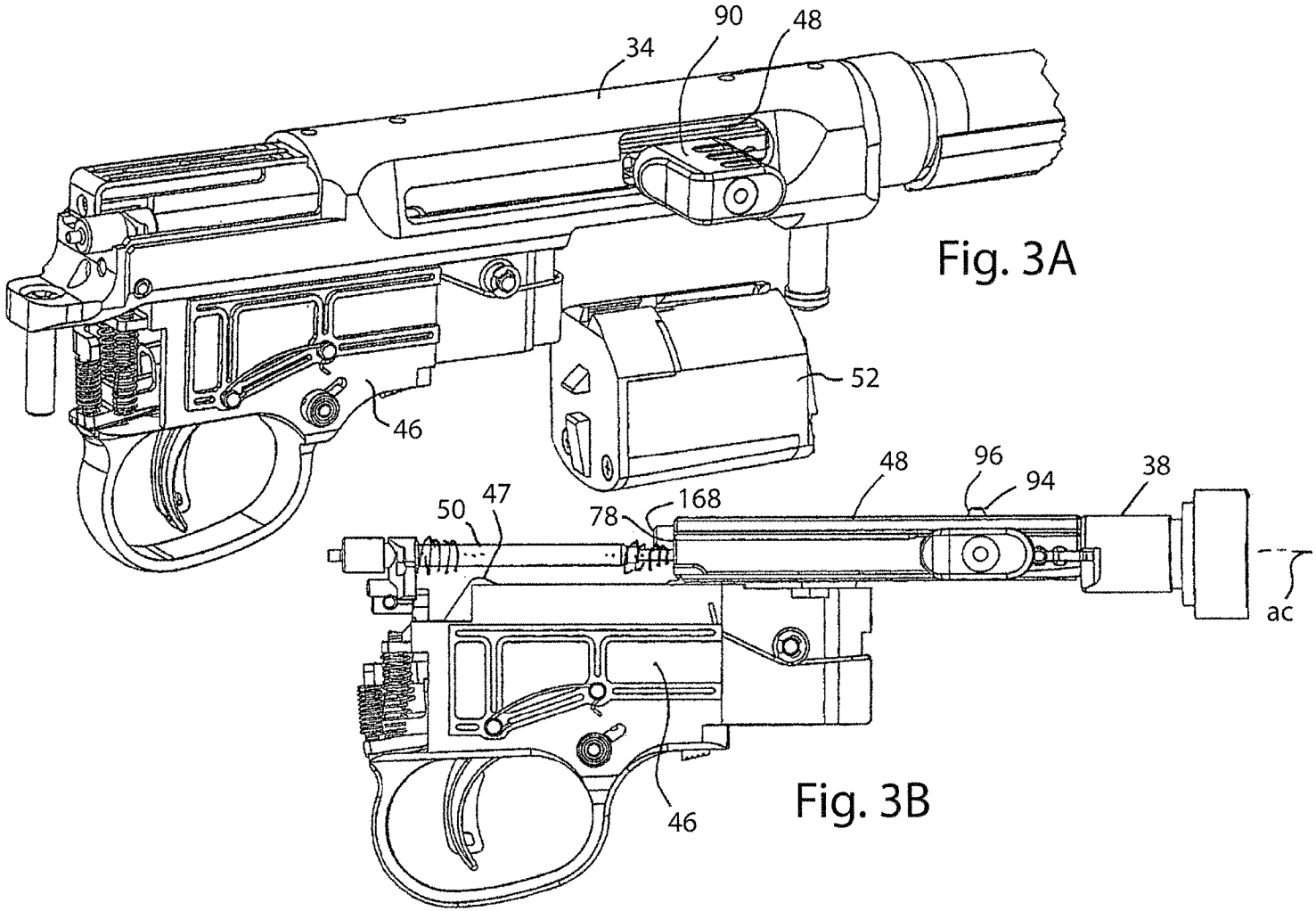
FIG. 3A is a perspective view of the firearm of FIGS. 1 and 2 with the stock and portions removed.
FIG. 3B is a side elevation view of the firearm of FIG. 3A with portions including the receiver removed.

Referring to FIGS. 1A-4, a semiautomatic firearm 30 according to embodiments of the invention is illustrated and generally comprises a housing 32 including a receiver 34, a barrel 36 with a bore 37 and a firing chamber 38, a stock 40 with a forestock portion 42, an ejection port 44, a trigger and firing assembly 46 with a hammer 47, a bolt assembly 48, a recoil spring assembly 50, and a magazine 52. In one example, the trigger and firing assembly may be inserted into the unitary stock and forestock component as shown in FIG. 2. Then the barrel and upper receiver assembled on top of that and coupled to the trigger and firing assembly. The bolt assembly and recoil spring assembly inserted into the rear upward opening 56 of the receiver with panels added.

The bolt assembly 48 is slidingly engaged in the receiver 34 to move forwardly and backwardly along a bolt assembly travel axis aa which also is also coincident with a barrel axis ab of the bore 37 and is generally a central axis ac of the firearm. The receiver generally has an interior 57 defining a breech region that receives the bolt assembly, an opening 58 that defines the ejection port 44, an inner surface 60 and a ceiling 61. Ledges 62 on the receiver 34 constrain the bolt assembly and may provide bearing surfaces for sliding engagement with the bolt assembly. An engagement surface defining a longitudinal cam surface 63 is fixed with respect to the receiver and may be on the ceiling 61 of the receiver. The cam surface includes a first surface 64 that is at a first elevation 64, a second displaced surface at a second elevation 65 that is configured as a recess surface 65, and a transition cam surface 67 which provides an inclined surface leading from the first surface to the second surface. The first surface is part of a linear portion 69 as illustrated is an inward cam portion 64 with respect to the bolt assembly. The recess surface 65 defining an outward cam portion 65 and the transition cam surface 67 being an inclined surface. In other embodiments the cam portions and cam surfaces may be part of a rib extending inwardly in the breech area or a separate piece attached to the receiver.

Referring generally to FIGS. 1-17, details of an embodiment of the bolt assembly 48 are illustrated, particularly showing features of the assembled bolt assembly. The bolt assembly has a forward face 68, a top side 70, a left side 72, a right side 74, a bottom side 76, and a rearward side 78. The bolt assembly comprises a bolt body 82 that may be a unitary form, a firing pin assembly 86, a retractable extractor 88, a manual handle assembly 90 with a manual handle 92, a bolt locking mechanism 93 including a movable member 94 that moves upwardly and downwardly about an axis b transverse to the axis aa, which may be perpendicular to the axis b, and that engages the cam surface 63 of the inside surface of the receiver. In embodiments, the bolt assembly has a firing pin blocking mechanism 95, discussed in detail below, which may utilize componentry of the bolt locking mechanism. The movable member has a cam follower surface 96 that engages a cam surface on the ceiling of the receiver. When engaged in the recess 66, the bolt assembly is in a locked position with respect to the in-battery position. Unlocking the bolt assembly, requires disengagement of the cam follower surface with the recess. When out of the recess the bolt is in an unlocked position. The cam surface may be part of the receiver or a separate component attached to the receiver.

Figure 15:
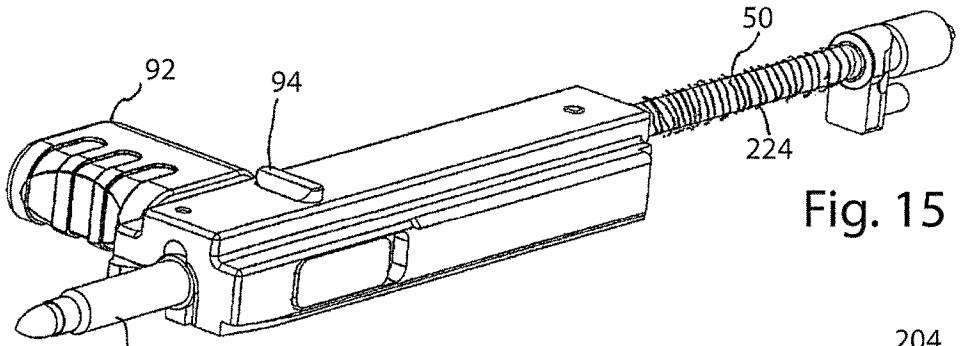
FIG. 15 is a perspective view of the bolt assembly with the recoil spring assembly engaged therewith and with a necked rimfire cartridge in the bolt headspace.
Figure 16:
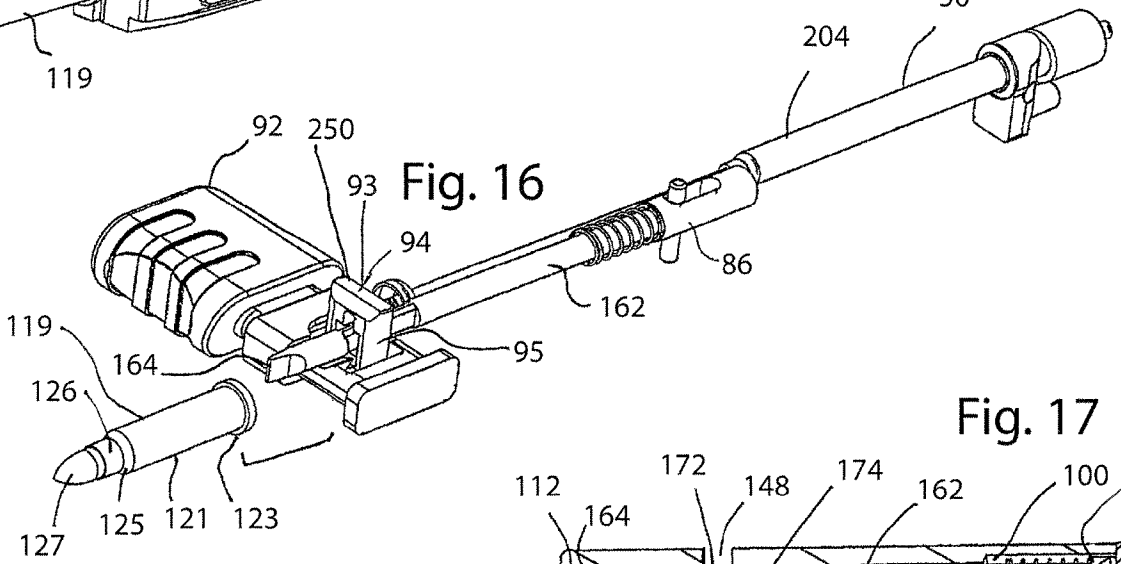
FIG. 16 is a perspective view of the bolt assembly of FIG. 15 with the bolt body removed.
Figure 17:
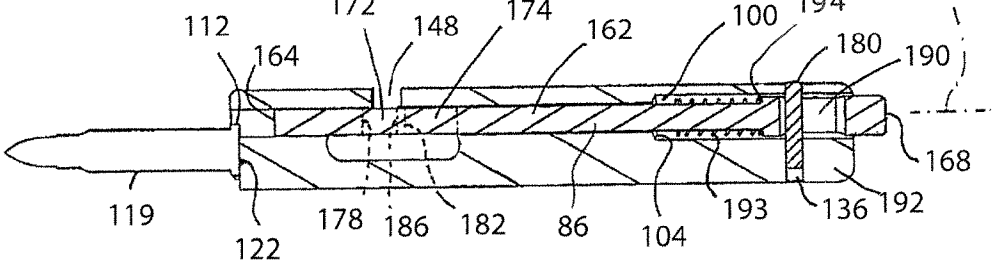
FIG. 17 is a cross-sectional through the bolt body and firing pin.
Figures 18, 19, 20, 21:
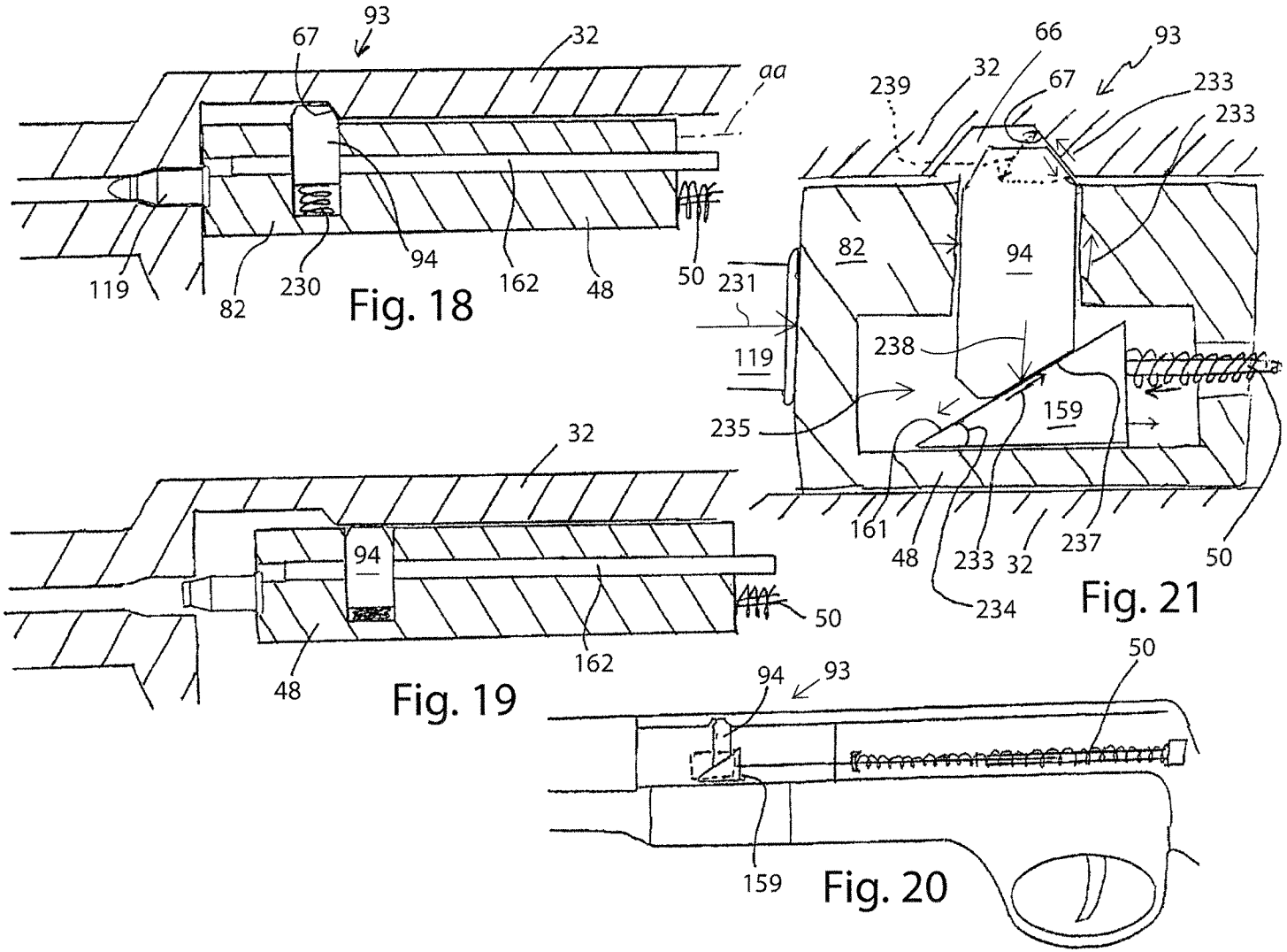
FIG. 18 is a side schematic elevation view of the semiautomatic firearm with a bolt locking mechanism.
FIG. 19 is a side schematic elevation view of the semiautomatic firearm of the FIG. 18 with the movable member unlocked.
FIG. 20 is a side schematic elevation view of the semiautomatic firearm with a bolt locking mechanism that has two reverse cam mechanisms.
FIG. 21 is a cross sectional view showing the bolt assembly mechanisms of FIG. 20 in detail.
Figure 30:
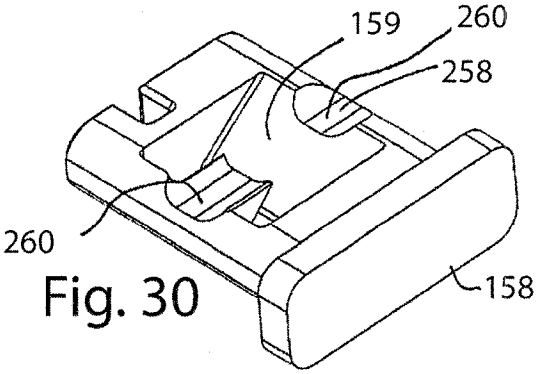
FIG. 30 is another perspective view of the carrier of FIG. 29.
Figure 29:
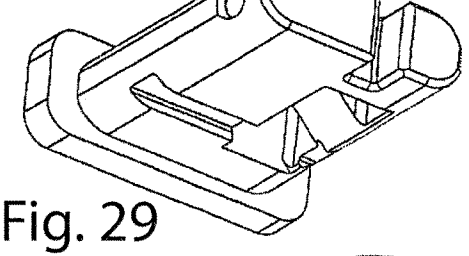
FIG. 29 is a perspective view a carrier for the movable/blocking member of FIGS. 26-28.
Figure 28:
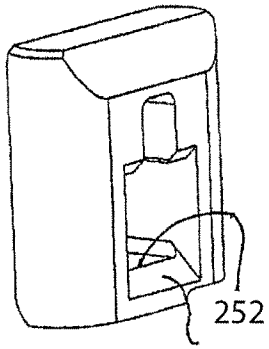
FIG. 28 is another perspective view of the movable/blocking member of FIGS. 26 and 27.
Figure 26:
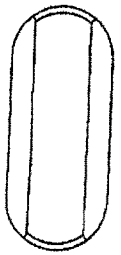
FIG. 26 is a top plan view of a movable/blocking member.
Figure 27:
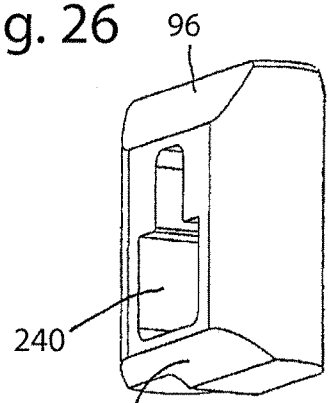
FIG. 27 is a perspective view of a movable/blocking member.

The bolt assembly 48 according to embodiments of the inventions, including the internal components, is illustrated in further detail in FIGS. 3-5, 7-17. The bolt body 82 has a firing pin opening or conduit 100 extending longitudinally through the bolt body that receives the firing pin assembly 86. The firing pin thus moves longitudinally in the opening along an axis of that is generally parallel to the central axis, the axis of the bolt assembly, The conduit is defined by the internal surface 102 and includes a spring stop surface 104 where greater bore 106 transitions to a lesser bore 108, see in particular FIG. 11. A cartridge head space 112 is defined on the forward face 68 of the body (and bolt assembly) and is defined by lip 114 which extends over an undercut region 115 and is generally of an inverted U-shape, defining a cartridge head receiving region 118 with a flat surface that engages the cartridge 119. As best illustrated in FIGS. 15 and 17, the cartridge 119, such as a necked rimfire cartridge, is received in the U-shaped recess and seats against the planar bolt head space surface, and is pushed into the undercut region by the retractable extractor 88. This is further described in a related application. The cartridge 119 is a high power rimfire cartridge and has a casing 121 with a casing head 122 and a rim 123. On the bullet end of the casing, a collar 125 and necked down portion 126 reduce the diameter of the casing to be sized for the bullet 127. When used herein, "necked rimfire cartridge" refer to these cartridges. Such cartridges have the primer propellant in the rim and do not have a central primer. The barrel and firing chamber are configured for receiving the necked rimfire cartridge as illustrated in FIGS. 18 and 19. The 0.17 HMR and 0.17 WSM are such cartridges.

The extractor and the cartridge head receiving region with the undercut has been found to reliably extract and eject cartridges in synergistic association with the componentry described herein and as such contribute to and are an integral part of providing a reliable, mechanically simple, semiautomatic firearm with improved performance, particularly for high power necked rimfire cartridges.

The trigger and firing mechanism 46 includes a double safety trigger 128 and pull adjustment 129. These are described in detail in a related application. The double safety trigger and trigger pull adjustment have been found to contribute to and are an integral part of providing a reliable, mechanically simple, semiautomatic firearm with improved performance, particularly for high power necked rimfire cartridges.

Figure 4:
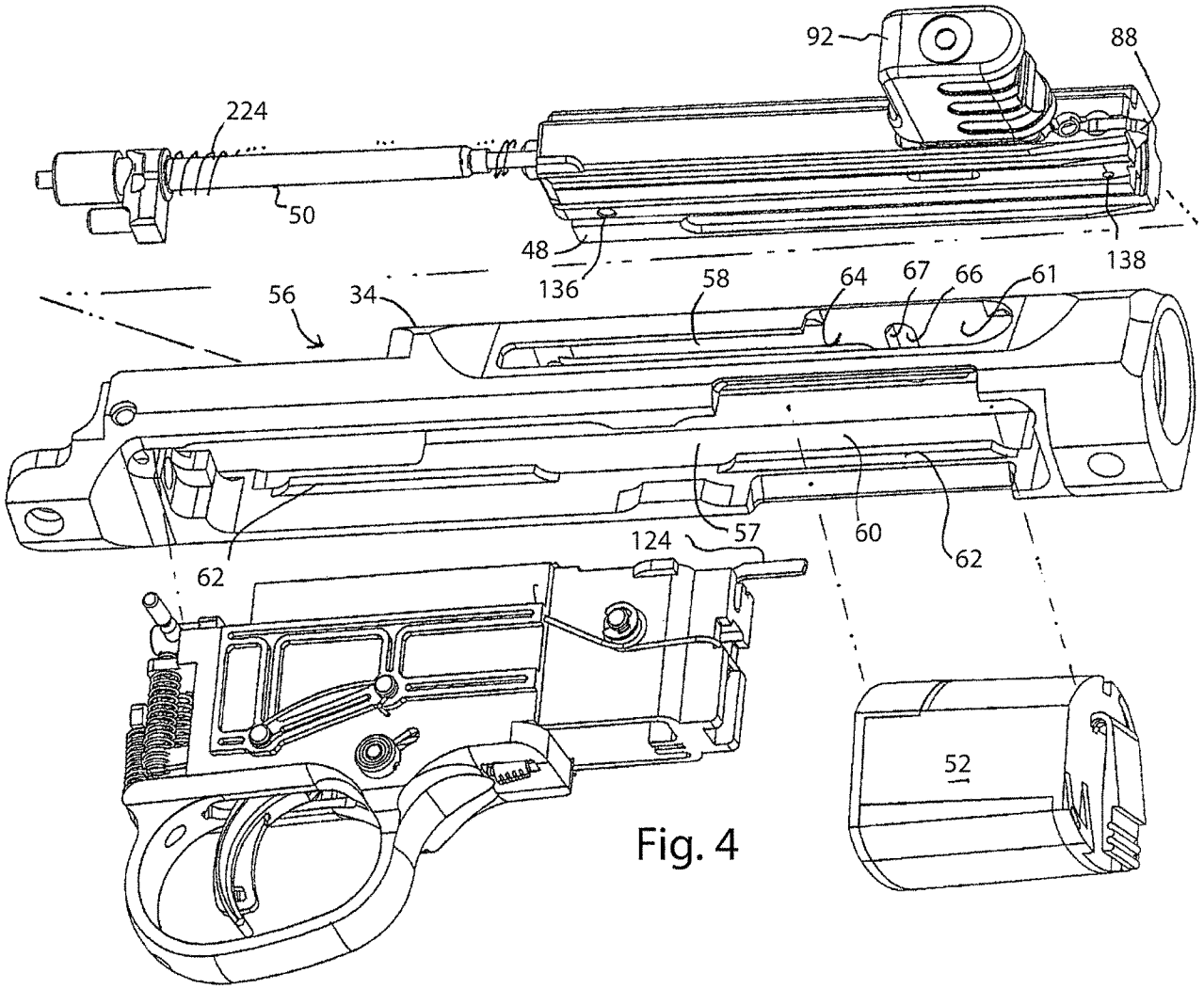
FIG. 4 is an exploded view of components of a firearm in accord with the inventions herein.
Figure 9:
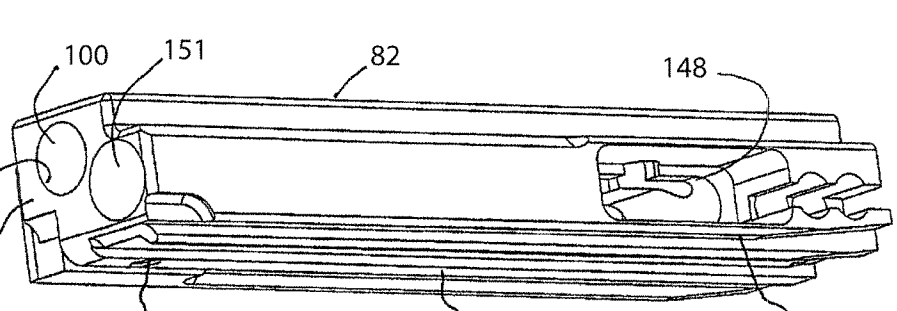
FIG. 9 is a perspective view of the bolt body of FIG. 13 taken from the right rear corner.
Figure 8:
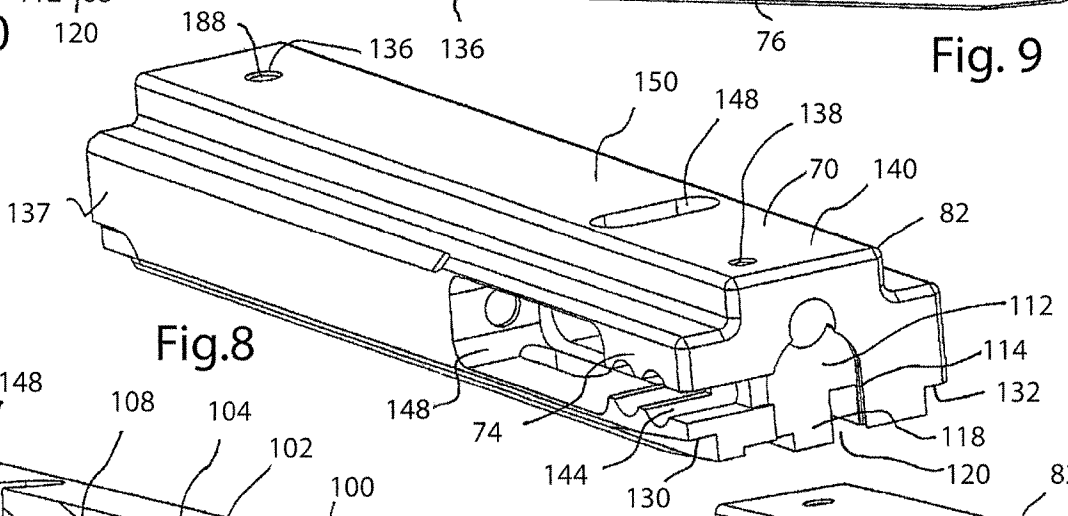
FIG. 8 is a perspective view of a bolt body taken from the right front corner
Figure 12:
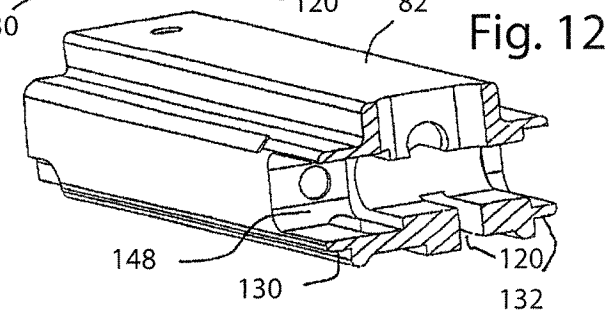
FIG. 12 is a cross-sectional view of a bolt body illustrating the apertures for the spanning member and the movable member.
Figure 10:
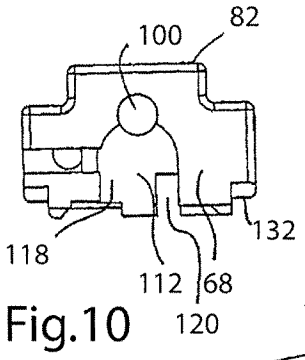
FIG. 10 is a front elevation view of the bolt body of FIGS. 13 and 14.
Figure 11:
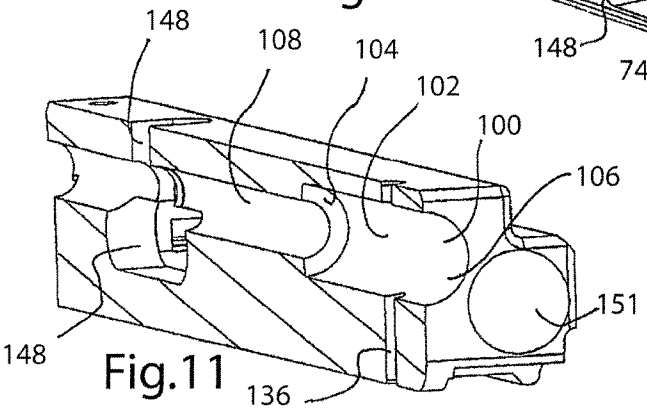
FIG. 11 is a cross-sectional view of the bolt body of FIG. 13 illustrating a spring recess for the bolt recycling spring assembly.
Figure 13:
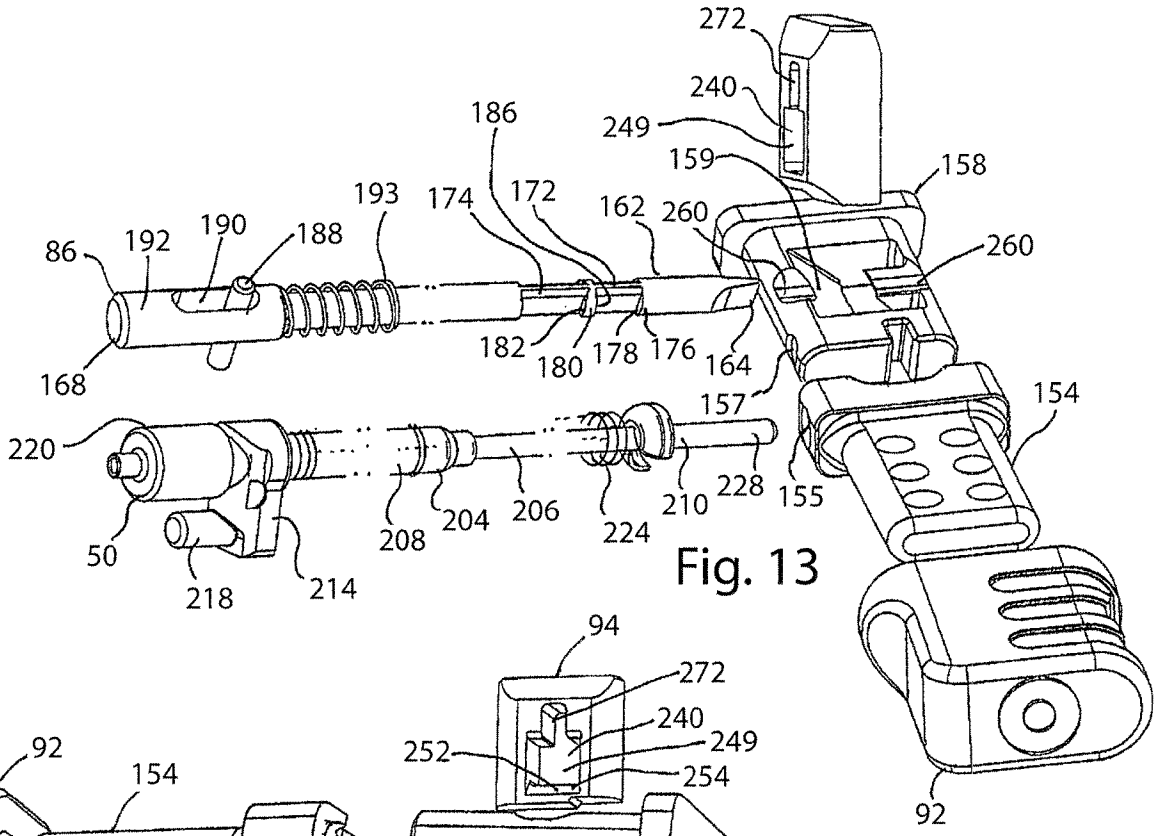
FIG. 13 is an exploded perspective view of the components of the bolt assembly except for the bolt body for purposes of illustration.
Figure 14:
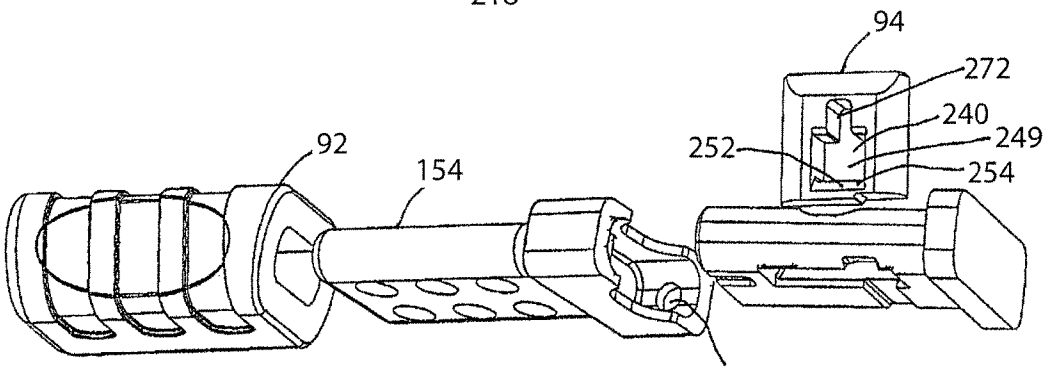
FIG. 14 is an exploded perspective view of the manual handle and connection means to the bolt body.

An ejector slot 120, shown best in FIGS. 8-10, receive the ejector 124, see FIG. 4, which extends along the bottom side 76 of the body. The ejector is fixed with respect to the receiver and kicks out a spent casing that is held by the bolt assembly, when the bolt assembly is blown back, see FIG. 9, Bearing surfaces 130, 132 of the bolt body, as seen in FIG. 8, engage the ledges 62 of the housing/receiver 34, see FIGS. 4 and 5. A pin aperture 136 for retaining the firing pin extends vertically through a rearward portion 137 of the bolt body, referencing FIGS. 8-12. A pin aperture 138 also extends vertically through a forward portion 140 of the bolt body 82 for retaining the retractable extractor 88. A slot 144 for receiving components of the extractor assembly extends horizontally inwardly on the right side of the forward portion of the bolt body. A further slot 148 for receiving components of the bolt locking mechanism and firing pin blocking mechanism (discussed below) extends through the forward portion of the bolt body from the left side to the right side and a slot on the top surface 150 of the bolt body guides and constrains the movable member 94, which in embodiments is part of the bolt locking mechanism 93 and the firing pin block 95. The movable member may thus be termed a movable blocking member or a blocking member or a locking member depending on context. The movable member may be said to "float" within the bolt body 82 in that it is only constrained and not fastened or directly attached to the bolt body. A longitudinally extending recoil spring assembly opening 151 extends from the rearward end to the slot 148 for the bolt locking mechanism and firing bin block.

The bolt assembly further has the manual handle 92 that extends out the ejection port 44 of the firearm. The manual handle is attached to an intermediary member 154 that has a side aperture 155 that is in alignment with the recoil spring assembly opening 151. A carrier or spanning member 158 for the movable member 94 is inserted into the slot 148 and extends from the left side of the bolt body to the right side and engages the movable member within the bolt body. The carrier member has a side aperture 157 in alignment with the intermediary member aperture 155 as well as the recoil spring assembly opening 151. The spanning member 158 has a ramp portion 159 with a ramp surface 161 that cooperates with a cooperating surface 160 on the movable member 94 such that as the ramp is moved forwardly or backwardly, the movable member raises or lowers respectively. The ramp surface acts as a cam surface and the movable member is a cam follower.

The firing pin assembly 86 and how it integrates with the bolt body is best seen in FIGS. 5, 11, 13, 16, and 17. The firing pin assembly, as illustrated, includes an elongate shaft defining the firing pin 162 and has a forward cartridge engagement tip 164 that has a flattened elongate shape for engaging the rims of rimfire cartridges and a blunt rearward end 168 that is struck by the hammer 47 (see FIG. 3). The firing pin has a pair of reduced diameter, or thinned, portions 172, 174 that define a forward stop portion 176 and first forward stop surface 178. Additionally, a second rearward stop portion 180 and respective second stop surface 182 is defined by the rearward reduced diameter or thinned portion 174. A third intermediate stop surface 186 is positioned between the forward and rearward stop surfaces. The functionality of these are discussed below. The firing pin is retained in the opening 100 by way of a pin 188 secured in the pin aperture and extending through a slot 190 in the rearward end portion 192 of the firing pin. A spring 193 is positioned in the firing pin opening 100 between a spring stop 194 on the firing pin and the spring stop surface 104 defined in the bolt body. The spring 193 provides a rearward bias to the firing pin.

The recoil spring assembly 50 and how is integrates with the bolt assembly is best illustrated in FIGS. 3, 5, 7, 13-16. The recoil spring assembly has a shaft 204 that, in an embodiment as illustrated, is telescoping with an inner shaft portion 206 and an outer shaft portion 208. A spring stop 209 is positioned on a forward end 210 of the shaft. A housing engagement portion 214 with an attachment lug 218 connects to the shaft 204 and is secured thereto by a shaft end piece 220. A recoil spring 224 is positioned under compression on the telescoping shaft between the housing or receiver engagement portion and the spring stop. The assembly is inserted into the recoil spring assembly opening which is sized to allow freedom of movement of the spring and telescoping shaft, particularly to compress and expand. A forward end 228 of the shaft 204 is inserted in the aperture 155 on the handle intermediary member 154 and extends into the aperture on the spanning member 158 thereby effectively locking the handle assembly and bolt locking mechanism 93 in place in the bolt body.

Embodiments of bolt locking mechanism 93 in accord with the inventions herein are illustrated in FIGS. 5-7, 15-22B. In embodiments, the movable member 94 extends from the bolt body and is movable inwardly and outwardly which in a normal firing position of a firearm, is vertically. The movable member is movable from an extended position as shown in FIGS. 5, 7, 18, 21, 22B, 30, 31, 35 to a retracted position as illustrated by FIGS. 19, 23B, 24B, 32, 33 and back and forth. In an embodiment as illustrated in FIGS. 18 and 19, the vertically movable member 94 has an outward (shown also as upward) bias as provided by, for example, a coil spring 230 and a cam follower surface on one end. In another embodiment, such as shown in FIG. 21, the movable member has cam follower surfaces on opposite ends. When the rimfire cartridge 119 is fired by impact with the firing pin with the rim 236 of the cartridge, the bolt assembly 48 cannot move rearwardly until the movable member is retracted. Since the force provided to retract the movable locking member is acting essentially at 90 degrees from the needed direction of retraction, there is a substantial force multiplication requirement of what is needed at the bolt to accomplish the retraction at the movable member. In the embodiment of FIGS. 18 and 19, the spring force of the coil spring 230 can be adjusted to provide appropriate retraction resistance of the movable member to delay the retraction and blowback. The recoil spring assembly 151 directly engages the bolt body 82 in this embodiment. In embodiments, the movable member can be positioned in different locations on the bolt to interact with the cam surface on the housing adjacent thereto. Although embodiments in this application illustrate cooperation with the engagement or cam surface 67 on the ceiling 61, the upper part of the receiver, interaction could also take place on the sides of the receiver or housing. More than one such movable member and cooperating cam surfaces can be utilized.

Referring to FIGS. 20 and 21, a further embodiment which has the upward bias on the movable member 95 but the bias is provided through the ramp portion 159 that has a forward bias provided by a recoil spring coaxial with the axis of the firearm barrel. Arrow 231 indicates the force applied to the bolt assembly 48 by a fired cartridge, said force is transmitted to the movable member 94 through the bolt body 82. In order for the bolt assembly to move rearwardly, the movable member needs to retract from the recess 66. The inclined surface 67 provides the downward reactionary force to move the movable member 94 downwardly. Additional metal to metal frictional forces, indicated by the arrows 233 provide resistance to the downward movement.

Additionally, the movable member must push the ramp portion 159 rearward with respect to and within the bolt body 82 to retract. This is accomplished by way of the downward force on the ramp surface 161. This rearward movement is "squeezing" the ramp portion or wedge out-of-the-way of the movable member. It can also be described as a reverse cam mechanism with the component which is configured as a cam follower pushing on the component that is configured as having the cam surface to move that component-the ramp portion. The resistance of the ramp portion to moving rearward is highly dependent upon angle 234, the lesser the angle the more downward force, as indicated by arrow 238, is needed.

Significantly, the carrier with the ramp portion moving forward is essentially has a reverse cam mechanism 235. That is, what would be traditionally a cam follower, the lower surface 237 of the movable locking member 94 is forcing the movement of what would normally be the cam surface, the ramp portion 159. And forcing it in a direction substantially normal to the force provided by the movable member and the ramp portion is biased against the movement by the recoil spring assembly 151. This provides a great multiplication of the blowback resistance of the bolt over what would be provided in a simple blowback arrangement where the resistance to blowback is provided by the inertia of the mass of the bolt assembly and the resistance provided by the recoil spring and frictional resistance. This mechanism also provides a dramatic increase over the configuration of FIGS. 18 and 19. The arrangement shown schematically in FIGS. 22A-25B has been shown by the applicant, in necked rimfire cartridges, to provide a highly reliable semiautomatic cycling action. Such reliability has not been commercially seen previously in a semiautomatic rifle for necked rimfire cartridges. The incline angles 234, 239 of the sliding surfaces can be adjusted to increase or decrease the force multiplication for blowback of the bolt assembly.

Referring to FIGS. 22A-25B, the sequence of stages in recycling the firearm with such a delayed blowback configuration as described with reference to FIGS. 20 and 21 above is illustrated. FIGS. 22A and 22B shows the bolt assembly in an in-battery condition, ready to fire. The movable locking member 94 is engaged in the recess in the ceiling of the receiver. In FIGS. 23A and 23B, the rearward force provided by the firing of the cartridge has forced the locking member downwardly by pushing the ramp portion rearwardly against the bias of the spring 224. In FIGS. 24A and 24B, the bolt is in the full retraction position, the spring is compressed and will return the bolt assembly to the in-battery position as illustrated by FIGS. 25A and 25B and urge the movable locking member 94 into the recess by way of the ramp portion 159.

The firing pin blocking mechanism 95 is illustrated best in FIGS. 5-7, 13-17, 31-43. In embodiments, the firing pin mechanism may be locked out in two ways, first by an interference with forward motion and secondly by way of removing the exposed striking end of the firing pin such that the hammer cannot strike it. The outwardly projectable movable member 94 is a blocking member with respect to this mechanism and function. The blocking member may have an inverted T-shaped opening 240 that cooperates with structure 242 on a forward portion 244 of the firing pin 162. The wedge 248 as illustrated in FIGS. 31-36 represents the ramp portion 159 or cam surface of the blocking member carrier 158 and FIGS. 37A-40B further illustrate the positioning of the firing pin 162 during different stages of operation. FIGS. 17, 31, 32, 37A, 37B, 40A, 40B correspond to the in-battery position of the bolt assembly in a ready-to-fire mode with the blocking member at an elevated position on the ramp portion and with the outward engagement tip 250 or cam follower surface 96 of the movable member 94 engaged in the recess 66. The movable blocking member 94 is thus in a non-blocking position and the firing pin is extending through the widest or largest portion of the opening, the non-blocking opening portion 249, of the inverted T-shaped aperture. This allows the firing pin structure, specifically the stop portions 176, 180, to pass through unobstructed. The movable blocking member may have a bearing surface 252 including a tapered lead-in surface 254 on which the firing pin may rest or engage during forward and rearward motion. Similarly, the blocking member carrier 158 including the ramp portion 159 may have cut away portions 258 and bearing surfaces 260. In this in-battery position, as best seen in FIGS. 17, 37A and 37B, the rearward striking end 168 of the firing pin is exposed out of the bolt body 82 and the forward tip 164 is displaced from the cartridge head space 112 in the bolt body.

Figure 31:
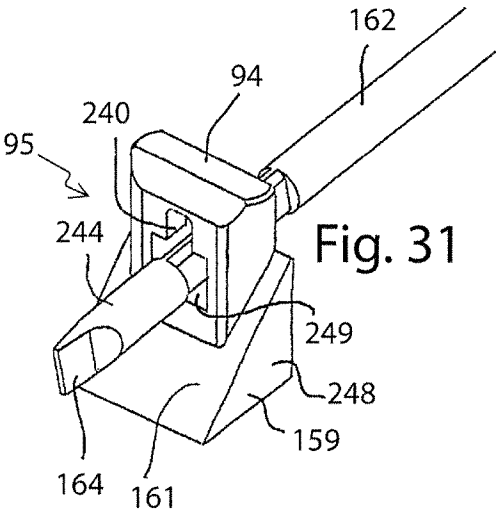
FIG. 31 is a perspective view of the movable member engaged with the ramp portion and in a non-blocking position with respect to the firing pin when the bolt assembly is in the in-battery position.
Figure 32:
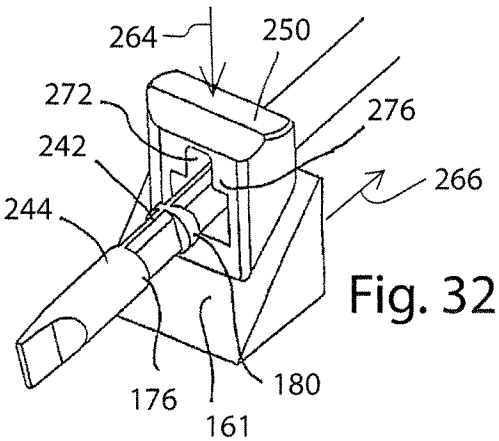
FIG. 32 is a perspective view of the assembly of FIG. 31 with the firing pin in the most forwardly position for firing the cartridge.
Figure 33:
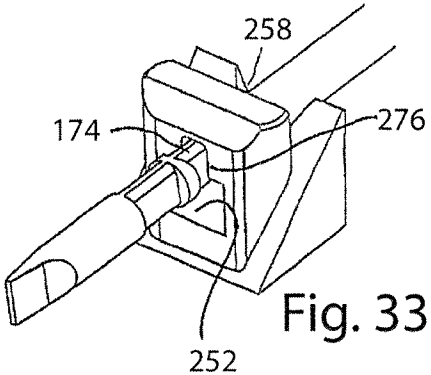
FIG. 33 is a perspective view of the assembly of FIGS. 31 through 32 with the outwardly projectable movable member lowered to be in a blocking position with the firing pin immediately after a cartridge is fired, the firing stop portion still forward of the movable member.
Figure 34:
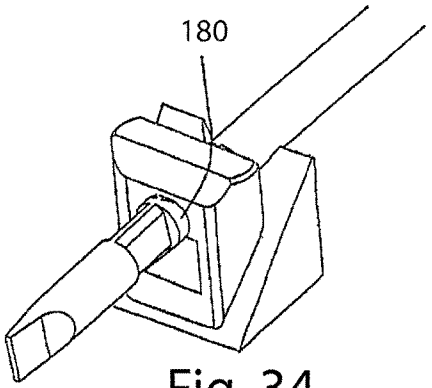
FIG. 34 is a perspective view of the assembly of FIG. 33 with the stop portion of the firing pin engaged with the movable member.
Figure 35:
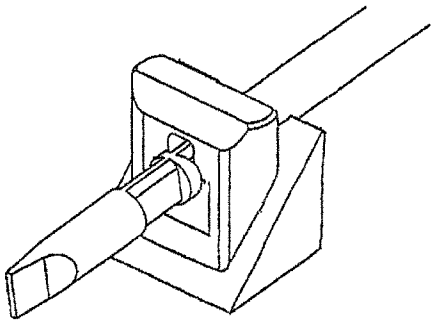
FIG. 35 is a perspective view of the assembly of FIGS. 31 through 34 with the movable member moving up the ramp from the position in FIG. 34 and the firing pin moving to a release position with the movable member.
Figure 36:
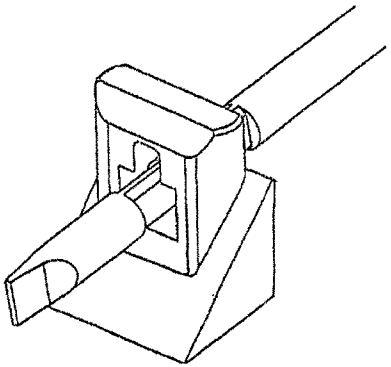
FIG. 36 is a perspective view of the assembly of FIGS. 31 through 35 the movable member in the non-blocking position with respect to the firing pin.

FIG. 32 illustrates the position of the firing pin with respect to the blocking member upon being struck by the hammer and impacting the cartridge. This generally is the furthermost forward position of the firing pin. The movable blocking member 94 is still engaged in the recess 66 in the ceiling of the receiver 34. In FIGS. 33, 38A, and 38B the force from the ignited cartridge has acted upon the bolt assembly driving same rearwardly as it forces the cam follower portion of the blocking member inwardly (downwardly), as indicated by arrow 264 in FIG. 32, by way of the transition cam surface 67. This inward (or downward) forces transmits the force downward on the ramp portion and due to the inclined surface engagement, forces the ramp portion, as indicated by arrow 266, and the blocking member carrier 158 rearwardly within the bolt body and further blows the entire bolt assembly rearward against the resistance provided by the recoil spring 224. With the blocking member moved downwardly as illustrated in FIG. 22C, the firing pin now passes through the narrowed blocking portion 272 of the firing pin opening 240. In the embodiment illustrated, the firing pin did not have time to retract after impacting the cartridge and a blocking portion 276 of the movable blocking member engages the rearwardmost reduced diameter or thinned portion 174, of the firing pin, see FIG. 33, and interferes by way of the more rearward stop portion 180. Further rearward retraction of the firing pin continues, see FIG. 34, as urged by the recoil spring 224. At this stage, the firing pin is fully retracted within the bolt body as illustrated by FIGS. 38A and 38B, shielded from the hammer, and the bolt assembly proceeds to its full recoil position as shown in FIGS. 39A and 39B with the firing pin still completely enclosed in the bolt body. When the bolt assembly returns towards the in-battery position, movable blocking member 94 will transition, as illustrated by FIG. 35, into the recess. In the fully seated position of the blocking member in the recess of FIGS. 36, 40A, and 40B as illustrated, the firing pin is now in the non-block region of the opening, is exposed out the rearward end of the bolt body 82 and the firearm is ready to fire. FIG. 34 presents a first position for the movable member where the firing pin is blocked and FIG. 31 presents a second position where the firing pin is not blocked.

Figures 41A, 41B, 42, 43, 44:
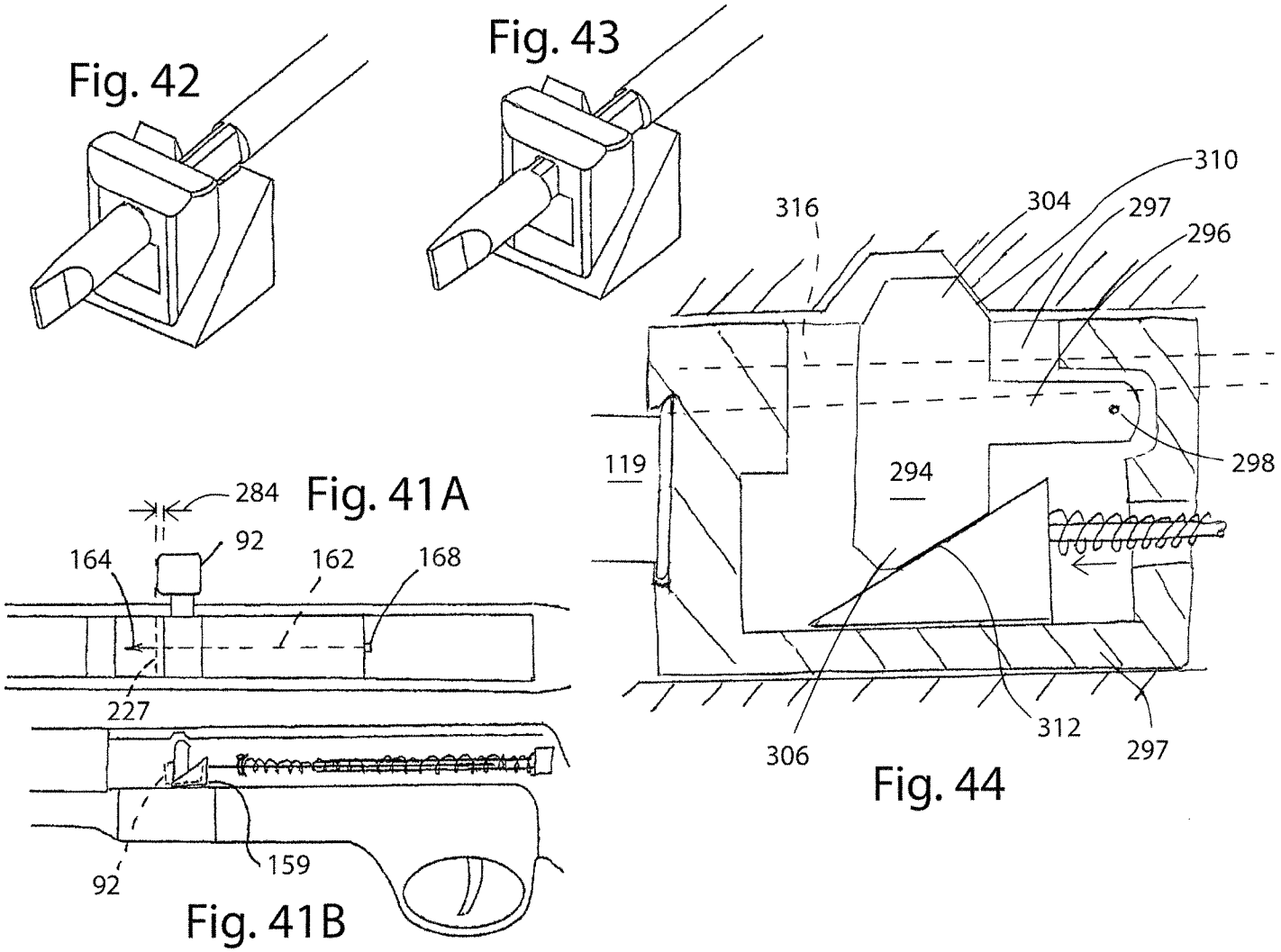
FIG. 41A is schematic plan view showing the position of the firing pin with respect to the bolt assembly with the manual handle and carriage being moved rearwardly with respect to the bolt body.
FIG. 41B is a schematic elevation view of the firing pin, movable member, and carrier, with respect to the position of 41A.
FIG. 42 is a perspective view of the assembly of FIGS. 31 through 36 with the ramp portion manually moved rearwardly lowering the movable blocking member to a blocking position also as portrayed in FIGS. 41A and 41B.
FIG. 43 is a perspective view of the assembly of FIG. 42 where the hammer has struck the firing pin and the blocking portion precludes the firing pin from traveling forward to the headspace of the bolt thereby precluding firing of a cartridge in the headspace.
FIG. 44 is a side elevational view of an embodiment where the movable blocking member is attached to the bolt body at a pivot point.

Referring to FIGS. 15, 41A, 41B, 42, and 43, use of the manual handle 92 when the bolt assembly is in the in-battery position is illustrated. In that there is forward and backward clearance between the movable blocking member carrier 159 and the slot 148 in the bolt body 82, the engagement of the cooperation between the blocking member 94 and the ramp portion may be manually effected. With the bolt assembly in the in-battery position, as illustrated in FIGS. 17 and 31, 37A, and 37B, the manual handle may be grasped and urged rearwardly against the force of the recoil spring which is directly connected to the handle and carrier assembly. Referring to FIG. 41, the manual handle may be moved from the original position 227, shown by the dashed line, to the position of the solid lines. In an embodiment, this can be accomplished without taking the bolt assembly out of the in-battery position. The clearance 284, see FIG. 41A, is sufficient such that the ramp portion may be moved from the position where the movable blocking member is extended and on the upper portion of the inclined surface to the position where the blocking member is on the lower portion of the inclined surface without moving the entire bolt assembly. The tip of the blocking member then is no longer engaged with the recess in the ceiling of the receiver. Additionally, with the lowering of the blocking member, the forward thinned or reduced diameter portion of the firing pin is captured in the narrow portion of the opening in the blocking member as illustrated in FIG. 42. Rearward movement of the handle may withdraw the cartridge from the chamber and with the firing pin locked as shown in FIG. 42, striking of the exposed rearward end 168 of the firing pin by the hammer will restrict the forward motion of the firing pin to that shown in FIG. 42 which is insufficient for the firing pin to reach the headspace where the cartridge is seated in the bolt body. Continued rearward movement of the handle with take the bolt position to that as illustrated in FIGS. 24A and 24B, where, if a cartridge is in the bolt face, the cartridge can be ejected by the ejector 124, shown in FIG. 4. A cartridge in the magazine will be loaded as the bolt returns to the in-battery position. This sequence is utilized for loading the first cartridge from the magazine.

Referring to FIG. 44, an embodiment is illustrated in which a movable member 294 has a pivot arm 296 and is pivotally connected to the bolt body 297 at a pivot point 298. The movable member has opposing ends 304, 304, with sliding engagement surfaces 310, 312. The movable member may have a recess or opening, not shown, for the firing pin 316 shown by dashed lines. Rather than floating within the bolt body, this embodiment has the member attached thereto. The motion is in an arc rather than the linear movement of the floating embodiment. In other embodiments, the configuration of FIGS. 18 and 19 could utilize a pivotally connected movable member as well and the spring bias, could be between the pivot arm and bolt body, or could be attached to other structure.

Firearms with delayed blowback mechanisms are known and firearms with firing pin blocks are known. See for example U.S. Pat. Nos. 4,344,246; 1,737,974; 1,410,270; 6,782791; 3,857,325; 2,975,680; and 5,666,754. These patents are incorporated by reference for all purposes. Aspects of the instant application will be suitable for incorporation in known mechanisms.

When used herein, the terminology "connect to" or "attach to" do not require direct component to component connection and intermediate components may be present.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

We claim:

1. A semiautomatic firearm, comprising:

a receiver with a barrel extending forwardly therefrom and defining a central axis, the barrel having a firing chamber configured for receiving a necked cartridge, the receiver having a longitudinal cam surface fixed thereon, the cam surface having a first surface with a recess surface displaced outwardly from the first surface defining a recess and an inclined surface extending between the first surface and the recess surface, a bolt assembly slidably engaged in the receiver and movable forwardly and rearwardly along the central axis and having an in battery position, the bolt assembly comprising:

a bolt body with a forward cartridge receiving region and a firing pin opening extending therethrough and positioned at a periphery of the cartridge receiving region;

a firing pin positioned in the opening and movable within the bolt body in a direction substantially parallel to or coaxial with the central axis; and a movable blocking member constrained with respect to the bolt body and being movable outwardly and inwardly with respect to the bolt body and transversely of the central axis, the outwardly projectable movable blocking member having a cam follower portion engaging and movable along the longitudinal cam surface, the movable blocking member having a blocking portion for blocking forward movement of the firing pin, a spring providing an outward bias to the blocking member;

wherein when the cam follower portion of the movable blocking member is engaged with the cam surface at the recess, the bolt is in the in-battery position and the blocking portion is not blocking the forward movement of the firing pin, wherein when the cam follower of the movable blocking member is out of the recess, the bolt assembly is out of battery and the blocking portion is positioned for blocking the forward movement of the firing pin in the bolt body, and wherein when the cartridge is fired, the firing causes a rearward force on the bolt that causes the cam follower portion of the movable blocking member to engage the inclined transition surface forcing the movable member inwardly against the outward bias provided by the spring and resistance to the movable member moving out of the recess by said spring delays the blowback of the bolt assembly;

wherein the bolt assembly further comprises a ramp portion movable forwardly and rearwardly with respect to and within the bolt body, wherein an end of the movable blocking member opposite the cam follower portion is engaged with the ramp portion and wherein the spring is connecting with the ramp portion thereby providing the outward bias to the blocking member; and wherein the firing pin extends through an opening in the movable blocking member and the opening having a reduced size region and an enlarged size region, the reduced size region associated with the movable blocking member blocking the firing pin.

2. The semiautomatic firearm of claim 1 wherein the movable blocking member is slidingly received in and floats within a slot in the bolt body.

3. The semiautomatic firearm of claim 1 wherein the spring also provides a forward bias to the bolt assembly such that as the bolt assembly is forced rearwardly the spring returns the bolt assembly to the in-battery position.

4. The semiautomatic firearm of claim 1, wherein the spring connecting with the ramp portion is compressed and extends forwardly and rearwardly in the bolt body thereby urging the ramp portion forwardly and thereby urging the movable blocking member outwardly.

5. The semiautomatic firearm of claim 1, wherein the bolt assembly further comprises a manual handle extending laterally with respect to the bolt body and connecting to the ramp portion whereby the bolt assembly can be moved manually rearwardly for ejecting cartridges.

6. The semiautomatic firearm of claim 1 wherein the cam follower portion of the movable blocking member is substantially flush with a top surface of the bolt body when the bolt assembly is out of battery.

7. The semiautomatic firearm of claim 1 wherein the firing pin has a stop portion that engages the blocking portion of the movable blocking member when the bolt assembly is out of battery.

8. A semiautomatic firearm comprising:

a barrel with a firing chamber, the barrel connecting to a receiver, and a reciprocating bolt assembly in a breach of the receiver;

wherein the bolt assembly comprising an elongate bolt body slidingly engaged with the receiver, a movable blocking member positioned in the bolt body having two ends, an outer end and an inner end, the outer end having a surface for moving engagement with a surface on the receiver as the bolt assembly reciprocates, the movable blocking member movable in a direction transverse to an axis of the reciprocating bolt assembly, wherein the moving engagement with the surface on the receiver by the outer end of the movable blocking member causes the movable blocking member to move inwardly and outwardly as the bolt assembly reciprocates, and wherein the movable blocking member interfaces with a firing pin to alternately block and not block movement of the firing pin as the bolt assembly reciprocates, wherein the inner end of the movable blocking member is part of a reverse cam mechanism providing resistance to movement of the movable blocking member inwardly, wherein the reverse cam mechanism further comprises a ramp portion that is movable longitudinally within the bolt body, wherein the inner end is slidingly engaged with the ramp portion, and wherein the ramp portion is biased to urge the inner end up the ramp and thereby urging the movable blocking member outwardly; and wherein the firing pin extends through an opening in the movable blocking member and the opening having a reduced size region and an enlarged size region, the reduced size region associated with the movable blocking member blocking the firing pin.

9. The semiautomatic firearm of claim 8 wherein movable blocking member is constrained within but not fastened to the elongate bolt body and wherein the moving engagement of the outer end with the surface on the receiver is a sliding engagement.

10. The semiautomatic firearm of claim 8, wherein the ramp portion is biased to urge the inner end up the ramp by a spring and the spring further urges the bolt assembly forwardly.

11. The semiautomatic firearm of claim 8 wherein the bolt assembly has an in-battery position and the in-battery position is associated with the movable blocking member being positioned in an outermost position and the movable blocking member not blocking the firing pin.

12. A firearm comprising:

a receiver connecting to a barrel with a firing chamber, a bolt assembly movable along a central axis within the receiver and slidingly engaged therewith, the bolt assembly slidingly movable into and out of an in-battery position, the bolt assembly comprising:

a bolt body with a firing pin extending through the bolt body;

a movable member extending outwardly from the bolt body and engaged with a surface external to the bolt assembly, whereby when the bolt assembly moves, the movable member is movable on the surface between an locked position and a non-locked position with a transition portion therebetween, the transition portion providing retention of the movable member in the locked position whereby the bolt assembly is maintained in the in-battery position and inhibited from moving out of the in-battery position to the non-locked position, the movable member interfering with the firing pin when the bolt assembly in not in the in-battery position, wherein the bolt assembly further comprises a ramp portion movable forwardly and rearwardly with respect to and within the bolt body and wherein an end of the movable member is engaged with the ramp portion, the firearm further comprising a spring connecting with the ramp portion and compressed thereby urging the ramp portion forwardly and urging the movable member up the ramp portion thereby urging the movable member outwardly; and wherein the firing pin extends through an opening in the movable blocking member and the opening having a reduced size region and an enlarged size region, the reduced size region associated with the movable blocking member blocking the firing in.

13. The firearm of claim 12 wherein the movable member is biased outwardly and the transition portion has an angled surface and the movable member is movable inwardly out of the locked position by rearward movement of the bolt assembly forcing the sliding engagement of the movable member with the angled surface thereby urging the movable member downwardly.

14. The semiautomatic firearm of claim 12 wherein the surface on the receiver is positioned such that when the bolt assembly is in an in battery position, the movable blocking member is in an outwardly position and indexed with a stop surface recess on the receiver.

* * * * *